United States Patent [19]

Owen

[11] Patent Number: 4,468,175

[45] Date of Patent: Aug. 28, 1984

[54] FLUID DRIVEN SUCCESSIVE STAGE BLADDER PUMP

[75] Inventor: Douglas B. Owen, Rochester, Mich.

[73] Assignee: D. W. Zimmerman Mfg., Inc., Madison Heights, Mich.

[21] Appl. No.: 425,515

[22] Filed: Sep. 28, 1982

Related U.S. Application Data

[63] Continuation-in-part of Ser. No. 175,281, Aug. 4, 1980, Pat. No. 4,360,320.

[51] Int. Cl.[3] ..... F04B 43/10; F04B 35/02

[52] U.S. Cl. ..... 417/394; 417/478; 417/244; 285/137 A

[58] Field of Search ..... 417/394, 121, 244, 478, 417/479; 285/133 A, 137 A

[56] References Cited

U.S. PATENT DOCUMENTS

| | | | |
|---|---|---|---|
| 1,766,382 | 6/1930 | Hardie et al. | 417/121 |
| 2,404,524 | 7/1946 | Norton | 417/394 |
| 2,435,179 | 1/1948 | McGovney | 417/394 X |

*Primary Examiner*—Richard E. Gluck
*Attorney, Agent, or Firm*—Allen D. Gutchess, Jr.

[57] ABSTRACT

A liquid pump is provided and particularly a downhole pump for use in an oil well bore for pumping oil or in a gas well for removing condensate. The downhole pump includes a plurality of pump and transfer modules, each of which has an elongate housing with end couplings and with two internal gas passages and a liquid passage extending therethrough. The pump module further has a bladder extending between the end couplings around the internal passages with the couplings having passages connecting one of the internal passages to space on one side of the bladder. When fluid, preferably gas, under pressure is supplied through the coupling passages, the bladder forces liquid therein upwardly into the next module. At the same time, fluid under pressure is exhausted through the coupling passages of the next pump module, aiding it to receive liquid from the pump module therebelow. The transfer modules supply the liquid up from a lower pump module to an upper one and connect the fluid passages to enable the fluid to operate the bladders. The components of the modules have several improvements over those disclosed in the parent application. The internal components also are all supported from the upper end so that they can expand toward the lower end. The elongate housings, including threaded end connections, are now of one-piece construction. The pump also includes a wellhead unit and a bottom unit.

33 Claims, 21 Drawing Figures

FLUID DRIVEN SUCCESSIVE STAGE BLADDER PUMP

This is a continuation-in-part of my copending U.S. application Ser. No. 175,281, filed Aug. 4, 1980, now U.S. Pat. No. 4,360,320.

This invention relates to a liquid pump for pumping liquid upwardly in a well.

The pump includes a plurality of modules, some of which are pump modules for pumping liquid, such as oil, upwardly and some are transfer modules for transferring the oil from one pump module to the next. Each of the modules, whether pump or transfer, includes an elongate housing having a lower coupling and an upper coupling. Each module also has two internal passages formed therein and extending between the lower and upper couplings. The lower coupling has a passage for supplying oil upwardly into the module and the upper coupling has a passage for receiving oil from the module and supplying it to the next module thereabove. The pump modules also have bladders located around the internal passages and extending between the lower and upper couplings. Each of the pump couplings also has passage means by which fluid, preferably gas, under pressure in one of the internal passages can be supplied to the space on one side of the bladder, preferably the outside, between the bladder and the housing. This gas moves the bladder in a manner to force the oil upwardly to the next module. The transfer modules transfer the oil upwardly from a lower pump module to an upper one and also connect the internal passages of the pump modules in a manner to alternate compressing and expanding motions of the bladders of the pump modules.

The pump can employ natural gas under pressure to operate the pump modules so that no electrical power is necessary, rendering the pumps particularly adaptable for remote locations. The components of the pump and transfer modules are made primarily of reinforced plastic for long life, with metal parts being a minimum. This is particularly true for such oils as sour crude which is high in hydrogen sulphide, rendering it toxic and corrosive. The modules also have relatively few seals and only two seals between moving parts. The new pump also is expected to have lower operating and maintenance costs than sucker rod pumps and can operate in non-linear deviated wells where sucker rod pumps may experience excessive rod wear.

The improved pump in accordance with the invention has the internal components of the pump and transfer modules all supported in a fixed relationship at the upper end of the tubular housing or production tubing in which they are located. The internal components are then free to expand downwardly or contract relative to the outer tubular housing because of weight carried by the tubular housing of other modules therebelow and because of temperature differentials. The tubular housing itself, including coupling components at the upper and lower ends, is of one-piece construction, thereby eliminating several parts and sources of potential leaks and structural failures. Coupling cores and other internal components are also, in part, made by different techniques to provide the ultimate in strength and precise dimensions. A gas sleeve around a portion of the coupling core is of a unique design, incorporating flexible end fingers which protect the bladder used in the pump module. An improved clamping band is also employed between the bladder and the coupling cores for more secure connections. In addition, the overall pump includes a lower, bottomhole joint or unit incorporating an additional check valve and an upper, wellhead or landing joint or unit down through which operaing gas is supplied and up through which oil is pumped.

It is, therefore, a principal object of the invention to provide an improved liquid pump having the advantages and features discussed above.

Many other objects and advantages of the invention will be apparent from the following detailed description of a preferred embodiment thereof, reference being made to the accompanying drawings, in which.

Figure 1:
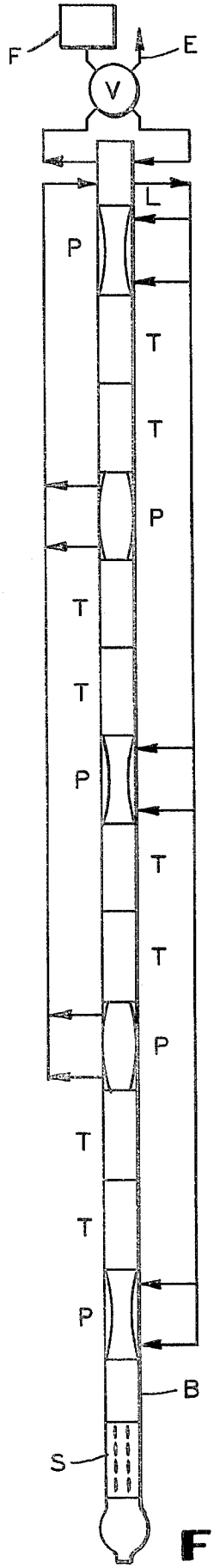
FIG. 1 is a diagrammatic view of a downhole pump according to the invention, including a plurality of pump modules and transfer modules.

The overall downhole pump in accordance with the invention is shown in FIG. 1. Pump modules which pump the oil or other liquid upwardly are designated "P" and transfer modules located between the pump modules and connecting them are designated "T". Fluid, preferably gas, under pressure is supplied to the pump modules "P", preferably to both ends thereof through two internal fluid lines, and the pump modules are also preferably exhausted at both ends through the fluid lines. For this purpose, a source of fluid under pressure is designated "F" above the surface of the ground and an exhaust vent "E" is also located above the surface, with the fluid and the exhaust vent "E" connected with the lines through a valve "V" and a wellhead landing unit "L". When fluid under pressure is supplied to the pump modules, flexible tubular members or bladders represented by the curved lines in the pump modules are compressed inwardly or squeezed to force oil therein upwardly to the next transfer module "T". When the gas is exhausted from the pump modules "P", the bladders expand to receive oil from the lower transfer module "T" which is being pumped upwardly by the next lower pump module "P". The oil is supplied through a filter sleeve "S" and a bottomhole unit "B".

The number of the transfer modules employed can vary from zero to about five. When no transfer modules are employed, the head against which the pump must pump is equal to the length of two of the pump modules "P". When one transfer module is added, the head is equal to the length of the two pump modules plus the length of the transfer module. Although the higher head results in more pressure against which the pump must work, the use of fewer pump modules and more transfer modules is advantageous because the transfer modules do not employ the bladders which add to the cost and also maintenance. With the pump and transfer modules typically being thirty feet long, with two pumps and four transfer modules, a head of 180 feet results.

The modules are made mostly of reinforced plastic materials which can withstand the attack of various chemicals and render the pump particularly suitable for pumping sour crude oil. By way of example, the pump is designed to be used to depths up to 5000 feet with a delivery rate of 100 barrels of liquid per day. The pump is also designed to operate at 100 PSI fluid pressure with a maximum bottomhole temperature of 170 degrees F. A check valve is employed in each module to prevent backflow of oil. It is also designed to open at a liquid pressure higher than normal to drain the oil prior to removal from the well.

Figure 2:
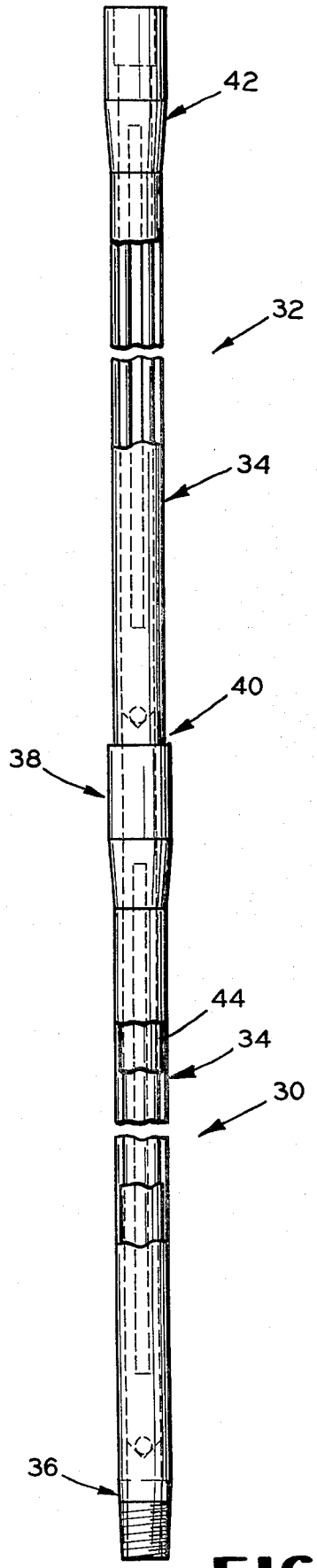
FIG. 2 is a schematic view, with parts broken away, of a pump module and a transfer module of FIG. 1.

Referring to FIG. 2, a pump module 30 and a transfer module 32 are shown schematically in assembled relationship. The pump module 30 has an elongate tubular housing or production tubing 34 with a lower coupling or connection 36 and an upper coupling or connection 38. Similarly, the transfer module 32 has the tubular housing 34 with a lower coupling or connection 40 and an upper coupling or connection 42. The couplings are connected by tapered threads and require no orientation when assembled. The couplings of the two modules have slightly different coupling cores, which is the reason for the different reference numerals. Each of the modules has means forming first and second passages between the couplings and the pump module 30 has a flexible member or bladder 44 of simple tubular shape extending between the couplings 36 and 38 and around the internal passages formed therebetween.

Figure 3:
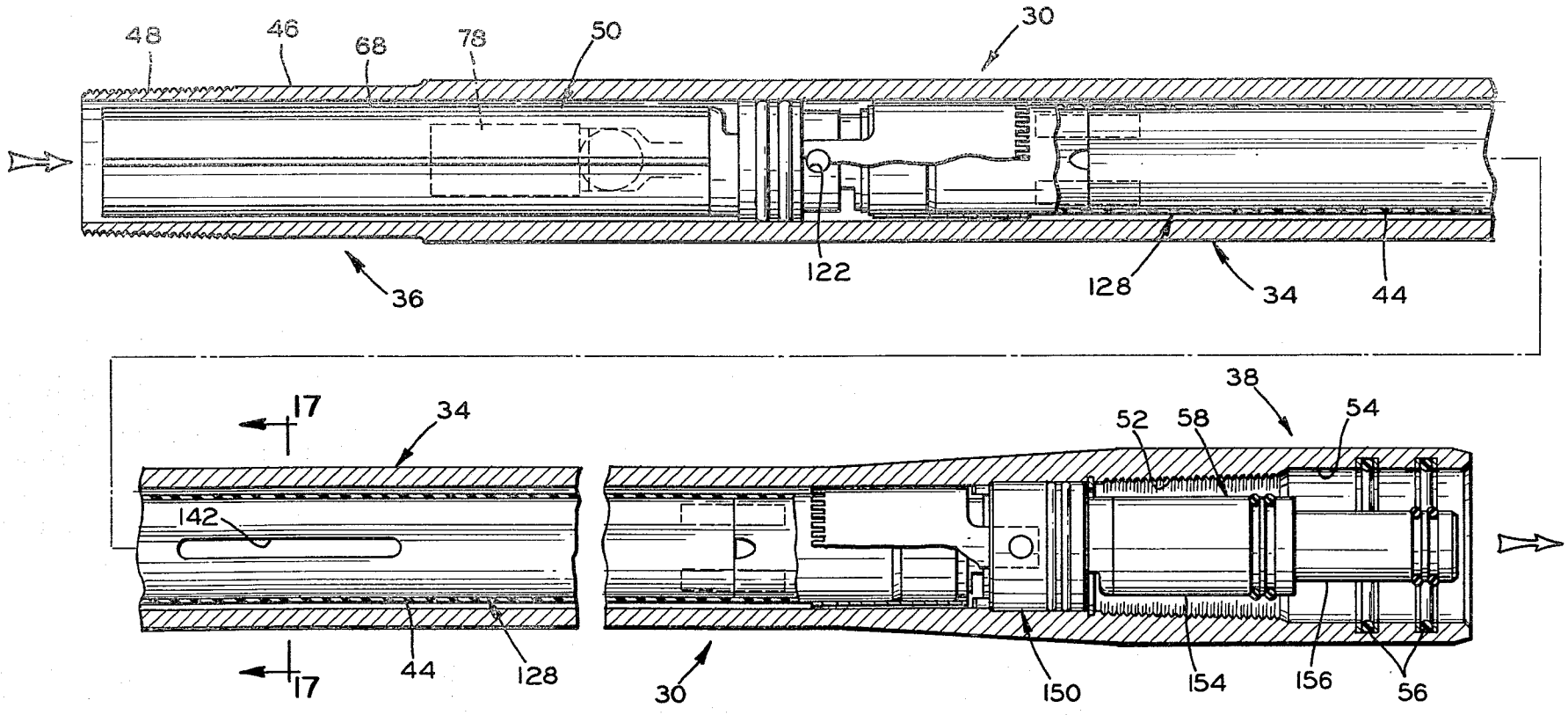
FIG. 3 is an enlarged, fragmentary view of the pump module of FIG. 2, with parts broken away and with parts in section.
Figure 4:
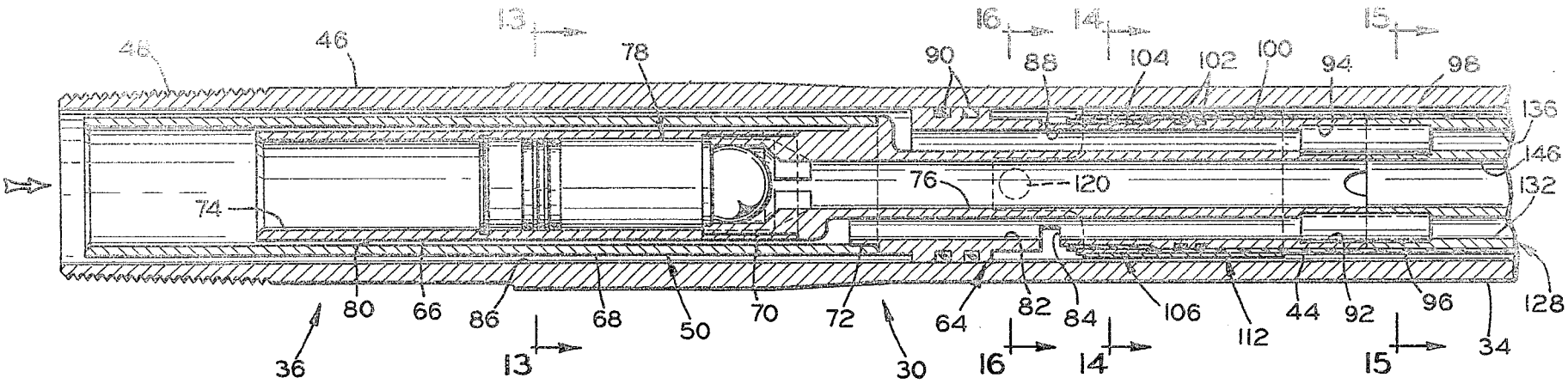
FIG. 4 is a further enlarged view in longitudinal cross section of the lower or left end of the pump module as shown in FIG. 3.
Figure 5:
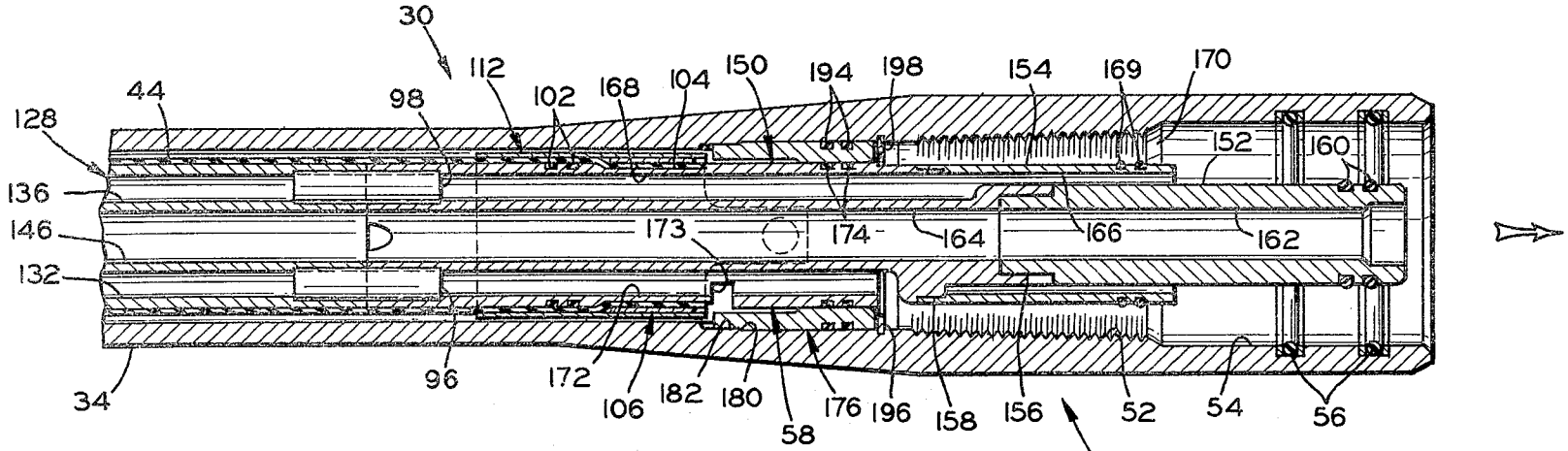
FIG. 5 is a further enlarged view in longitudinal cross section of the upper or right end of the pump module as shown in FIG. 3.

Referring to FIGS. 3–5, the lower coupling 36 of the pump module 30 includes a cylindrical portion 46 below which extends a threaded projection 48. The coupling 36 also includes a coupling core 50. The upper coupling 38 of the pump module 30 includes a threaded recess 52 which threadedly receives the projection 48 of the next module and has a cylindrical recess 54 which receives the cylindrical portion 46 of the next module. The cylindrical recess 54 has two sealing O-rings 56 which contact the cylindrical portion 46 in sealing relationship. The upper coupling 38 also includes a coupling core 58.

Figure 11:
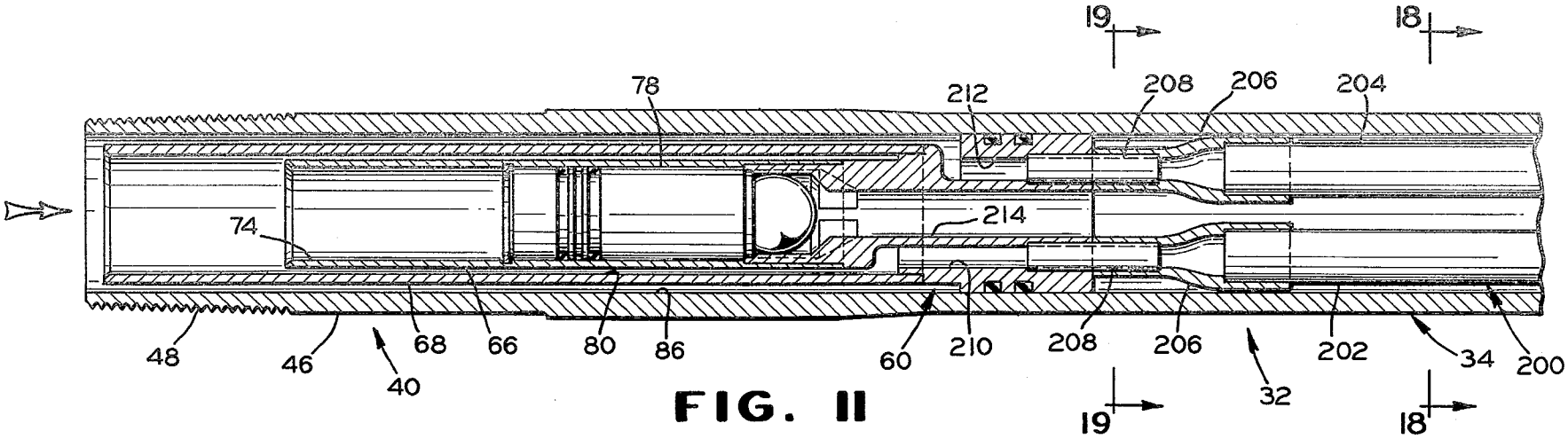
FIG. 11 is a view in longitudinal cross section taken through the lower end of the transfer module of FIG. 2.
Figure 12:
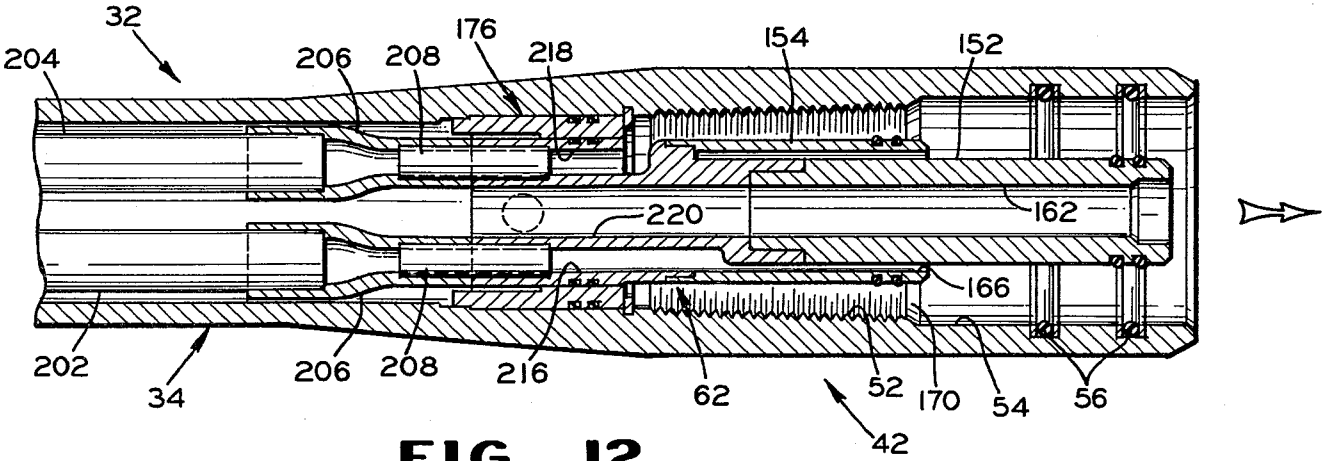
FIG. 12 is a view in longitudinal cross section taken through the uper end of the transfer module of FIG. 2.

Referring to FIGS. 11 and 12, the lower coupling 40 of the transfer module 32 has the cylindrical portion 46 and the threaded projection 48 with a somewhat modified coupling core 60. The upper coupling 42 of the transfer module 32 has the threaded recess 52, the cylindrical recess 54, and the O-rings 56 with a somewhat modified coupling core 62.

Referring again to FIGS. 3–5, the coupling core 50 of the lower pump coupling 36 includes a center core 64, an inner sleeve 66, and an outer sleeve 68. The center core and sleeves are made of reinforced thermoset plastic material. The center core is molded and the sleeves are pultruded to eliminate mold draft and to maintain closer tolerances for the long pieces. The inner sleeve 66 is bonded to the center core 64 along a joint line 70 (FIG. 4) and the outer sleeve 68 is bonded to the center core along a joint line 72.

Figure 13:
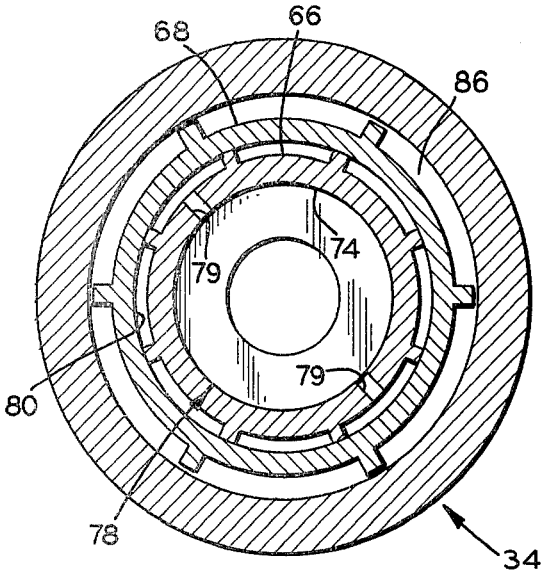
FIG. 13 is an enlarged view in transverse cross section taken along the line 13—13 of FIG. 4.

The inner sleeve 66 forms a central passage 74 (see also FIG. 13) for oil and communicates with a central passage 76 in the center core 64. A check valve 78 in the passage 74 enables the flow of oil upwardly but prevents downward flow under normal pressures. The check valve 78 can be opened when gas normally supplied through holes 79 is exhausted and liquid pressure is above operating pressure, to enable the oil to drain downwardly through the string of modules, when desired. The check valve is disclosed more fully in U.S. Pat. No. 4,360,320 and will not be discussed in detail.

Figure 14:
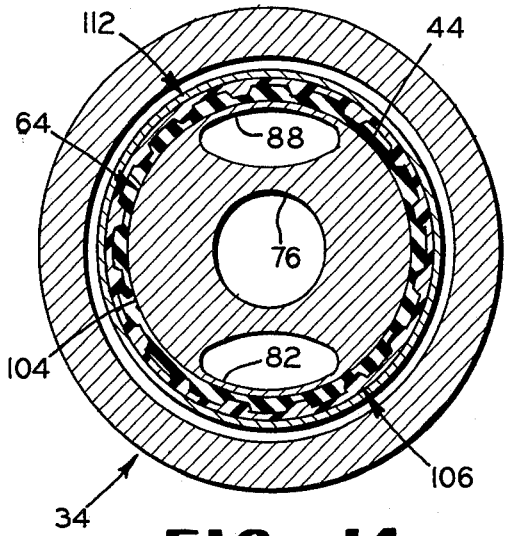
FIG. 14 is an enlarged view in transverse cross section taken along the line 14—14 of FIG. 4.

An annular gas passage 80 is formed between the inner sleeve 66 and the outer sleeve 68 and communicates with a first gas passage 82 (see also FIGS. 13 and 14) on one side of the oil passage 76 in the center core 64. The core 64 has a notch 84 therein through which gas in the passage 82 is supplied to or received from the annular space outside the bladder 44. A second annular gas passage 86 is formed between the outer sleeve 68 and the housing 34 and communicates with a second gas passage 88 in the center core 64 on the side of the oil passage 76 opposite the first gas passage 82.

The center core 64 also has sealing rings 90 which seal with the housing 34 but the coupling core 50 is free to move longitudinally relative to the housing. The core 64 also has countersunk recesses 92 and 94 at the ends of the gas passages 82 and 88 to receive oval nipples 96 and 98 (see also FIG. 15) which are bonded therein and extend beyond the end of the center core 64.

Figure 7:
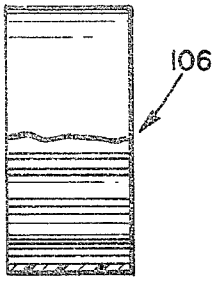
FIG. 7 is a view on a smaller scale in elevation, with parts broken away and with parts in section, of the clamping band of FIG. 6.
Figure 6:
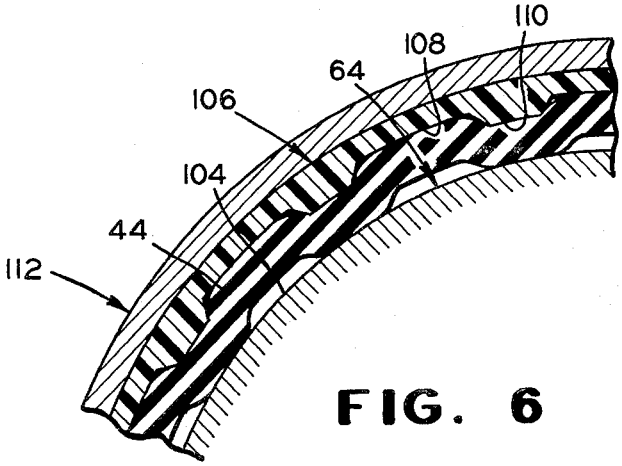
FIG. 6 is a somewhat schematic, greatly enlarged, fragmentary view in transverse cross section of a clamping band, bladder, and certain components of the pump module.
Figure 10:
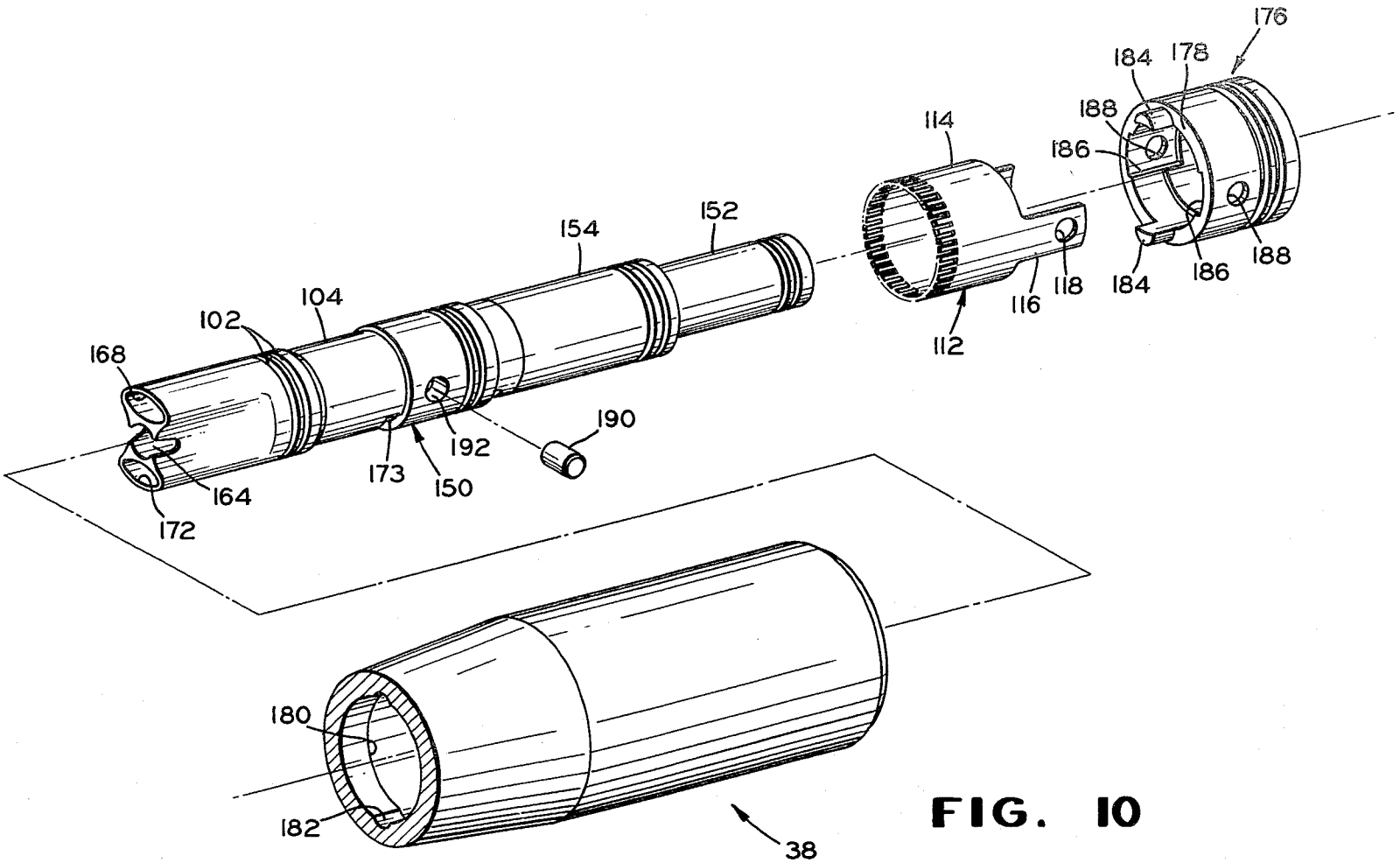
FIG. 10 is an exploded view in perspective of an upper core portion of a pump module, including the gas and supporting sleeves.

The core 64 also has a reduced cylindrical outer portion 100 with sealing rings 102 over which the lower end of the bladder 44 extends, with the latter extending therebeyond to a shallow annular recess 104 (FIGS. 6 and 14) in the core. In this location, the bladder is tightly secured to the core 64 by a shrink clamping band 106 (see also FIG. 7) which clamps the end of the bladder 44 securely against the annular recess 104 of the core 64. The outer surface of the center core tapers from the cylindrical portion 100 to a generally hourglass configuration at the end, as shown in FIG. 10.

The shrink band 106 (FIGS. 6 and 7) has shallow axially extending recesses 108 and ridges 110 which form a generally undulating shape on the inner surface of the band 106. This enables the band to take up in the recesses 108 the excess bladder material which occurs as the band shrinks onto the bladder and clamps it against the surface of the annular recess 104 of the core. Although the band design is unique, the band material itself is commercially available. It comes in a sealed package and when the band is removed and exposed to air when placed over the bladder, it shrinks to the clamping state over a period of time of about forty-five minutes. Again, however, the band with the undulating inner surface is unique.

Figure 8:
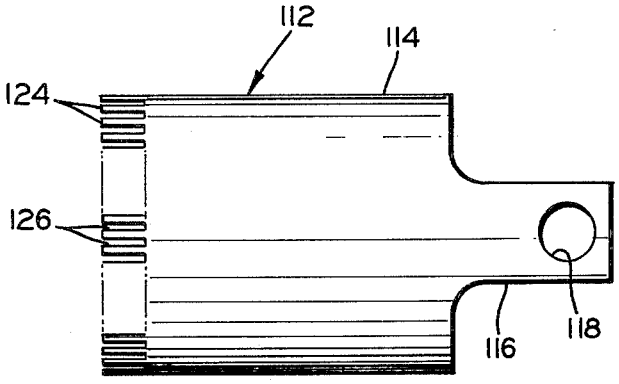
FIG. 8 is a side view in elevation of a gas sleeve used in the pump module.
Figure 16:
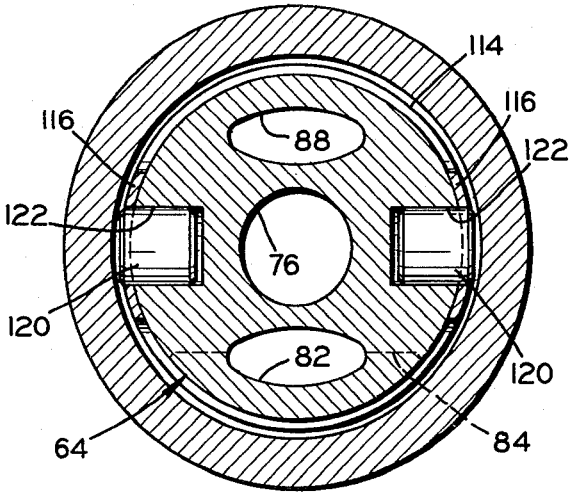
FIG. 16 is an enlarged view in transverse cross section taken along the line 16—16 of FIG. 4.

A gas sleeve 112 (FIG. 8) of glass-filament-wound, thermoset plastic material is located around an end portion of the bladder 44 and the shrink band 106. The gas sleeve 112 has a main cylindrical portion 114 with two diametrically-opposed, axially-extending tangs 116 with dowel holes 118 therein. These receive dowel pins 120 (FIG. 16) which extend inwardly through the outer surface of the center core 64 and into transverse bores 122 therein. The opposite end of the sleeve 112 has a multiplicity of axially-extending flexible fingers 124 (FIG. 8) with slots 126 therebetween. These fingers 124 can deflect outwardly against the inner surface of the housing 34 and still enable the passage of gas through the slots 126 and through the annular space between the outer surface of the cylindrical portion 114 of the sleeve and the inner surface of the housing 34. When the bladder 44 is expanded and under extreme pressure, the flexible fingers 124, by deflecting outwardly against the wall, prevent a portion of the bladder from extruding into the space between the sleeve and the housing, which could result in mechanical abrasion and early failure of the bladder.

Figure 15:
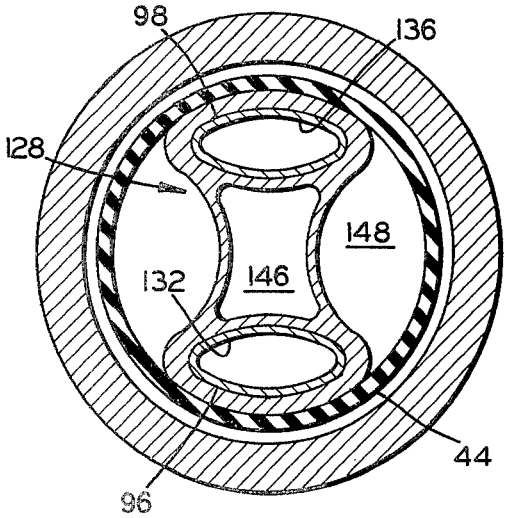
FIG. 15 is an enlarged view in transverse cross section taken along the line 15—15 of FIG. 4.
Figure 17:
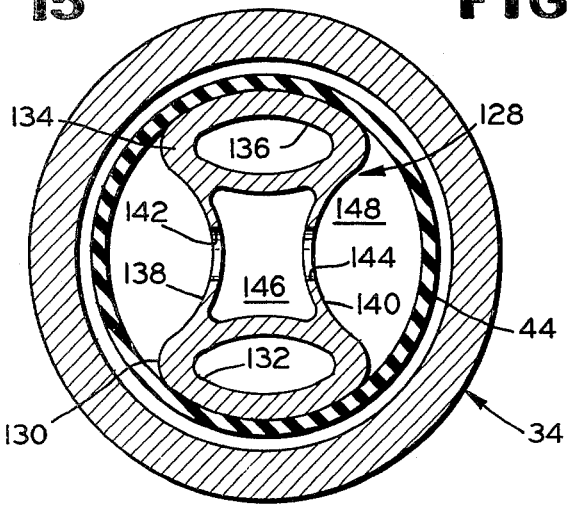
FIG. 17 is an enlarged view in transverse cross section taken along the line 17—17 of FIG. 3.

A passage-forming member or means 128 (FIG. 4) extends from the center core 64, this member preferably being extruded of thermoset plastic material. As shown in FIGS. 15 and 17, the member has a generally external hourglass shape, the outer perimeter of which substantially equals the inner circumference of the bladder 44. Consequently, when the bladder is squeezed and is substantially in contact with the outer surface of the member 128, it is neither stretched nor compressed, thereby minimizing physical wear. The member 128 includes a lower bulbous portion 130 forming an oval gas passage 132. The member 128 also has an upper bulbous portion 134 forming an upper gas passage 136. The passages 132 and 136 are connected with the lower and upper passages 82 and 88 of the core 64 by being bonded to the nipples 96 and 98. The bulbous portions 130 and 134 are connected by webs 138 and 140 having elongate slots 142 and 144 (also FIG. 3). The slots can be all along the length of the member 128 but are always at the lower end portion thereof. These slots enable communication between a central chamber 146 defined by the webs and a space 148 located outside the member 128 and within the bladder 44, the central chamber 146 also communicating with the oil passage 76.

The passage-forming member 128 extends upwardly to the upper coupling core 58 (FIGS. 3 and 5) which also includes a center core 150, an inner sleeve 152, and an outer sleeve 154. These are bonded to the center core 150 along bond lines 156 and 158, respectively. The inner sleeve 152 has outer O-ring seals 160 to form a seal with an inner sleeve of the next upper module, the sleeve 152 also forming an oil passage 162 which communicates with a corresponding passage of the next module. The passage 162 also communicates with a central oil passage 164 in the core 150 which communicates with the central chamber 146 and the space 148 within the bladder.

An annular gas passage 166 is formed between the inner and outer sleeves 152 and 154 and communicates with an upper gas passage 168 in the core 150, this passage also communicating with the gas passage 136 in the passage-forming member 128. The outer sleeve 154 has two O-ring seals 169 which form a sealing engagement with the outer sleeve of the next upper module so that the passage 166 also communicates with the corresponding annular passage in the next upper module. An outer passage 170 around the outer sleeve 154 communicates with an outer passage around the corresponding outer sleeve of the next module when the module 30 is connected therewith, and also communicates with a lower gas passage 172 in the core 150. The latter then communicates with the gas passage 132 in the member 128 and with the space outside the bladder 44 through an opening or notch 173 (see also FIG. 10).

Figure 9:
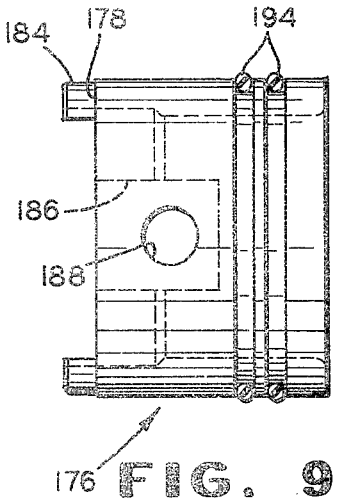
FIG. 9 is a view in elevation of a supporting sleeve used at upper end portions of the pump and transfer modules.

The center core 150 is connected to the upper end of the bladder 44 through the seals 102 and the clamping band 106 with the gas sleeve 112 or a substantial equivalent located therearound. The center core 150 also has outer sealing rings 174 which, in this instance, seal with a support sleeve 176 (see also FIGS. 9 and 10). The support sleeve 176 has an annular end 178 which seats on a shoulder 180 in the coupling 38. The coupling having two diametrically-opposite grooves 182 which receive two diametrically-opposite tangs 184 extending axially from the support sleeve 176. The sleeve also has two diametrically-opposite shallow recesses 186 lying perpendicular to the tangs 184 and having central openings 188 which receivve dowel pins 190. These also extend through the openings 118 in the gas sleeve tangs 116, the tangs being received in the shallow recesses 186, in this instance. The pins 190 then extend into transverse bores 192 in the center core 150. The support sleeve 176 also has outer annular seals 194 sealing with the inner surface of the upper coupling. When the support sleeve 176 is in place, a snap ring 196 (FIG. 5) is inserted in an annular groove 198 behind the sleeve to secure it in place.

With this arrangement then, the entire internal components of the pump module 30 are supported from the support sleeve 176 at the upper end. This enables the internal components including the coupling core 50, the passage forming member 128, and the coupling core 58 to be supported through the sleeve while the lower coupling components can move relative to the outer housing or tubing. The pump module can then accommodate various changes in temperatures and the outer housing can stretch when supporting weight of additional modules therebelow. Such stretch can exceed an inch in longer strings of tubing, by way of example.

The transfer module of FIGS. 11 and 12 will now be discussed. The transfer module is employed only to transfer oil up toward the next pump module 30 and to supply gas to and exhaust gas from the lower pump modules. The transfer module 32 differs basically from the pump module 30 in that no bladder is employed. Consequently, no other core notches or openings are employed nor are the gas sleeves required. The coupling core 60 of the lower coupling 40 of the transfer module 32 differs from the core 50 of the pump module primarily in that the notch or opening is eliminated or is unnecessary and the core is also shorter, with a tapered end portion and annular recess for clamping the bladder being eliminated. The same comments are basically true of the upper core 62 of the transfer module.

Figure 19:
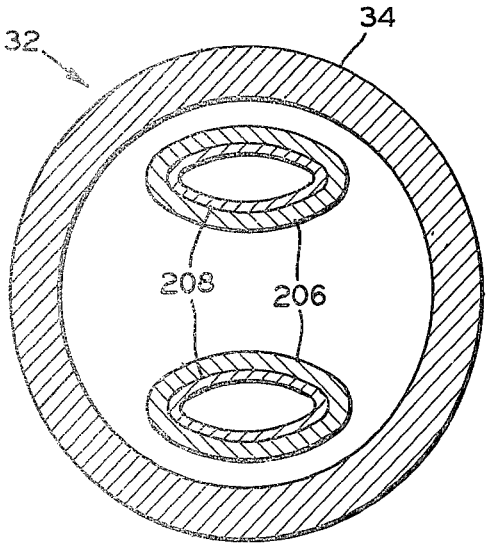
FIG. 19 is an enlarged view in transverse cross section taken along the line 19-19 of FIG. 11.
Figure 18:
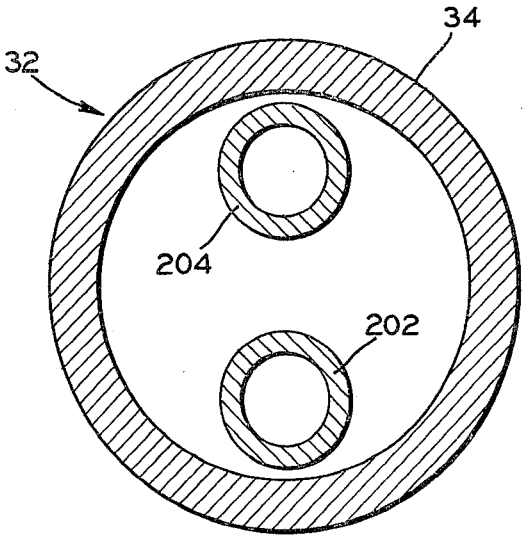
FIG. 18 is an enlarged view in transverse cross section taken along the line 18—18 of FIG. 11.

Passage-forming means 200 is connected between the lower and upper cores 60 and 62. The passage-forming means in this instance include two round, pultruded tubes 202 and 204 (see also FIG. 18) of reinforced thermoset plastic material which are bonded to glass-filament-wound connectors 206 of thermoset plastic material at lower and upper ends. These, in turn, are bonded to nipples 208 (see also FIG. 19) extending out of the center cores 60 and 62. At the lower ends, the gas tubes 202 and 204 communicate with passages 210 and 212 in the core 60 and these, in turn, communicate with the passages 80 and 86 formed by the inner and outer sleeves 66 and 68. A central oil passage 214 in the core 60 also communicates with the oil passage 74 formed by the inner sleeve 66 beyond the check valve 78.

At the upper end, the gas tubes 202 and 204 communicate with gas passages 216 and 128 in the core 62 and these connect with the passages 166 and 170 formed by the inner and outer sleeves 152 and 154. The core 62 also has a central passage 220 for oil which communicates with the passage 162 in the inner sleeve 152.

As with the pump module, the internal components of the transfer module are supported by the support sleeve 176.

The pump modules 30 and the transfer modules 32, when used, should be connected so that the gas passage 132 of the upper pump modules communicates with the gas passage 136 of the next lower pump module and vice versa. This enables the bladder 44 of the upper pump module to expand as the bladder 44 of the lower pump module is being squeezed and contracted, and vice versa. The internal components of the transfer module 32 are assembled so that the gas tube 202 therein communicates with the gas passage 132 of the pump module above and with the gas passage 136 of the pump module below and the gas tube 204 communicates with the gas passage 136 of the pump module above and with the gas passage 132 of the pump module below, or vice versa. With this arrangement, the same gas tubes of two or more adjacent transfer module, when used, can communicate with one another and provide a straight flow therethrough so that any number of transfer modules can be employed. It is only important that the transfer modules be arranged so that alternate gas passages of the adjacent or closest pump modules will be in communication with one another.

Figure 20:
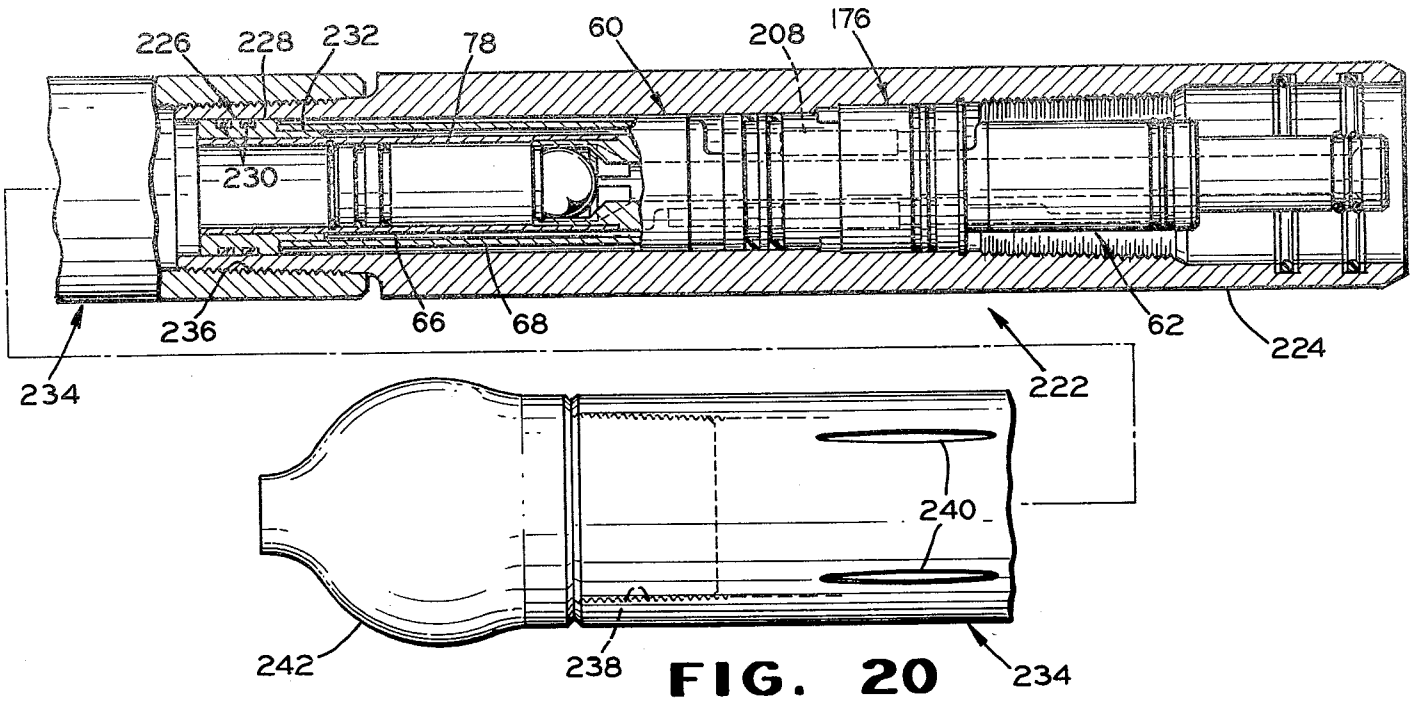
FIG. 20 is a view in elevation, with parts broken away and with parts in section, of a bottomhole unit and filter sleeve.

Referring to FIG. 20, a bottomhole joint or unit 222 is shown. This unit is located below the lowest pump module 30. The unit includes a relatively short tubing or housing 224, the ends of which, however, are similar in configuration to the ends of the housing 34. The bottomhole unit 222 includes the transfer core couplings 60 and 62, or similar couplings, which can be directly connected by the nipples 208 or similar connectors. The bottomhole unit 222 has one of the check valves 78 therein as an additional safety factor. It also has a gas plug or stop 226 at the lower end which closes off the gas passages at the lower end of the unit. The plug 226 has a large diameter 228 with O-rings 230 sealing the plug with the inner surface of the housing 224 and a reduced diameter portion 232 extending between the sleeves 66 and 68. In place of the plug 226, a pressure-operated dump valve opened at higher-than-operating pressures can be used in each gas passage to drain condensate from the gas passages.

A filter sleeve 234, which can be in the order of ten feet long, has two female threaded ends 236 and 238 and intermediate slits 240. The upper threaded end 236 is connected to the bottomhole unit 222 and the lower threaded end 238 is connected to a bulbous spacer guide 242. This spaces the inlet slits 240 from the casing, having a larger diameter than the filter sleeve 234.

Figure 21:
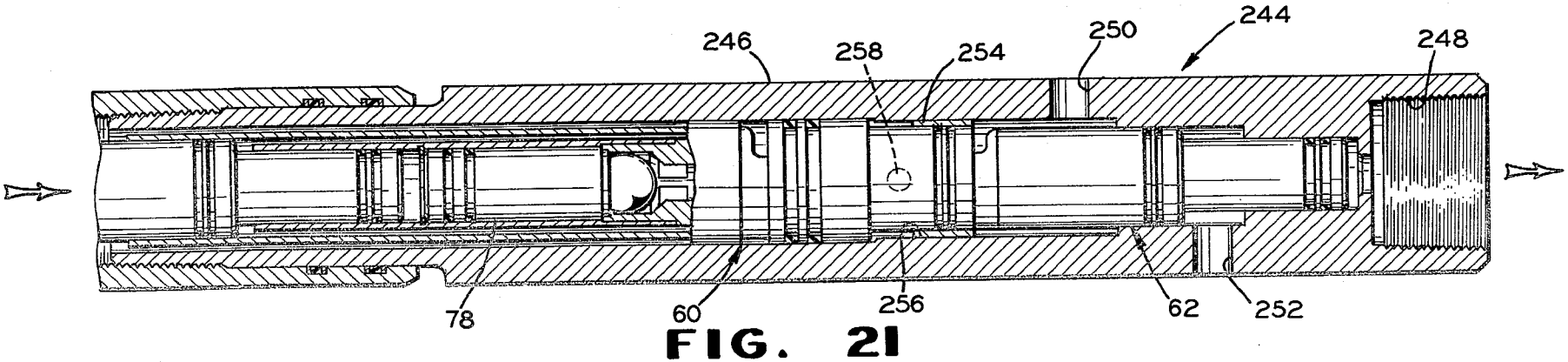
FIG. 21 is a view in longitudinal cross section of a well-head landing unit through which operating gas is suppllied to the string and through which liquid exits.

A landing joint or unit 244 (FIGS. 1 and 21) is used at the wellhead, at the top of the string. This unit receives the oil or other liquid pumped up the string and also supplies the operating gas to the modules in the string. The unit 244 includes a housing 246 which, in most instances, will be shorter than the housing 34 of the pump and transfer modules but will be longer than the housing 224 of the bottomhole unit 222. The unit includes the cores 60 and 62 which are preferably joined by tubes similar to the tubes 202 and 204 of the transfer module, depending upon the length needed or desirred for the landing joint. The lower end of the housing 246 has a male threaded configuration similar to that for the housing 34 and the upper end has a female threaded connection 248 to receive an oil transfer pipe. Operating gas is supplied to the outer passage through a transverse supply opening 250 and is supplied to the inner passage through a transverse supply opening 252. In this instance, a sleeve 254 is bonded to the inner surface 256 of the housing 246 and provides a sealing surface. The internal components of the unit 244 are supported by two dowel pins 258 which pass through the housing 246 into the upper core 62. The landing joint also has one of the check valves 78 to prevent back flow of liquid.

All of the transfer modules need not have the check valves 78 as long as the transfer module above each pump module has one. Such a transfer module could be much shorter than the others. A check valve also could be incorporated in the upper core of the pump module to eliminate all check valves in the transfer modules.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. A liquid module for use in a well, said liquid module including an elongate housing, a lower coupling core located in a lower end portion of said housing in sealing engagement therewith, an upper coupling core located in an upper end portion of said elongate housing, passage-forming means extending between said lower core and said upper core and forming passages therebetween, said passage-forming means being affixed to both of said cores, said cores having passage means communicating with said passages for supplying gas to and receiving gas from said passages, and said coupling cores having additional passage means for supplying liquid upwardly through said elongate housing around said passage-forming means between said cores, said upper core having support means engaging an upper portion of said elongate housing for supporting said lower coupling core and said passage-forming means from said upper coupling core.

2. A liquid module according to claim 1 wherein said module is a pump module and includes a flexible tubular bladder positioned around said passage-forming means and extending between said lower coupling core and said upper coupling core, and at least one of said coupling cores having means including a portion of the passage means therein for connecting one of said passages with one side of said flexible bladder.

3. A liquid module according to claim 1 characterized by said elongate housing having a shoulder at an upper end portion thereof, and said support means of said upper coupling core being a support sleeve connected thereto and cooperating with said shoulder to support said lower core and said passage-forming means from said upper core.

4. A liquid module according to claim 1 wherein said liquid module is a pump module and includes a flexible tubular bladder positioned around said passage-forming means and extending between said lower coupling core and said upper coupling core, at least one of said coupling cores having a transverse opening communicating with the outside of said flexible bladder, said one coupling core having a gas sleeve positioned therearound adjacent the corresponding end of said bladder near said transverse opening, said gas sleeve having a plurality of flexible fingers positioned around said one coupling core and extending in a direction toward the other coupling core, said flexible fingers being positioned to flex outwardly adjacent the inner surface of said housing when said bladder is expanded.

5. A liquid module according to claim 4 characterized by said transverse opening being in said upper core and pin means connecting said gas sleeve and said support means to said upper coupling core.

6. A liquid module according to claim 1 wherein said module is a pump module and includes a flexible tubular bladder positioned around said passsage-forming means and extending between said lower and upper coupling cores, said coupling cores having cylindrical end portions received within the corresponding ends of said bladder, and shrink bands located around the bladder ends and clamping the bladder ends on said cylindrical portions of said coupling cores.

7. A liquid module according to claim 6 characterized by said shrink bands having generally undulating inner surfaces engaging the bladder.

8. A liquid module according to claim 6 characterized by a gas sleeve positioned around each of the bladder ends and around each of said shrink bands and having tangs connected to the corresponding coupling core.

9. A liquid module according to claim 8 characterized by said support means comprising a support sleeve connected to said upper coupling core with said gas sleeve.

10. A liquid module according to claim 9 characterized by said tangs of the upper gas sleeve being received in shallow grooves in said support sleeve and connected by common pin means to said upper coupling core with said support sleeve.

11. A liquid module according to claim 1 wherein said elongate housing is of one piece construction and has upper and lower threaded end portions, said lower coupling core having concentric lower inner and outer sleeves extending downwardly therefrom, said lower inner sleeve forming a central liquid passage, said lower inner and outer sleeves forming an annular gas passage, and said lower outer sleeve forming an annular outer gas passage with a lower end portion of said housing, said upper coupling core having concentric upper inner and outer sleeves extending upwardly therefrom, said upper inner sleeve forming a central liquid passage, said upper inner and outer sleeves forming an annular gas passage, and said upper outer sleeve forming an annular gas passage with an upper end portion of said housing, said upper inner sleeve sealing with a lower inner sleeve of an adjacent module, said upper outer sleeve sealing with a lower outer sleeve of the adjacent module to form continuations of said liquid and said gas passages when the upper threaded end portion of said elongate housing is threadedly attached to the lower threaded portion of the adjacent module.

12. A liquid module for use in a well, said liquid module including an elongate housing having a lower coupling and an upper coupling, said lower coupling having a lower threaded portion and a lower cylindrical portion, said upper coupling having an upper threaded portion and an upper cylindrical portion, said lower coupling further comprising a lower coupling core located in a lower end portion of said housing and having concentric lower inner and outer sleeves extending downwardly therefrom, said lower inner sleeve forming a central liquid passage, said lower inner and outer sleeves forming an annular gas passage, and said lower outer sleeve forming an annular outer gas passage with the lower end portion of said housing, said upper coupling further comprising an upper coupling core located in an upper end portion of said housing and having concentric upper inner and outer sleeves extending upwardly therefrom, said upper inner sleeve forming a central liquid passage, said upper inner and outer sleeves forming an annular gas passage, and said upper outer sleeve forming an annular gas passage with the upper end portion of said housing, said upper inner sleeve sealing with a lower inner sleeve of an adjacent module and said upper outer sleeve sealing with a lower outer sleeve of the adjacent module to form continuations of said liquid and gas passages when the upper threaded portion of said elongate housing is threadedly attached to the lower threaded portion of the adjacent module.

13. A liquid module according to claim 12 characterized by passage-forming means extending between said lower core and said upper core and forming passages therebetween, a flexible bladder positioned around said passage-forming means and extending between said cores, and shrink bands having generally undulating inner surfaces engaging the bladder and clamping the bladder on said lower and upper cores.

14. A liquid module according to claim 12 characterized by said elongate housing having a shoulder at an upper end portion thereof, a support sleeve around said upper core and connected thereto, said support sleeve cooperating with said shoulder to support said upper core therefrom.

15. A liquid module according to claim 14 characterized by sealing means engaging said lower coupling core with the inner surface of said elongate housing for sealing but slidable movement therebetween.

16. A liquid module according to claim 12 characterized by passage-forming means extending between said lower coupling core and said upper coupling core, a flexible, tubular bladder positioned around said passage-forming means and connected to said lower coupling core and said upper coupling core, at least one of said coupling cores having a transverse opening communicating with the outside of said flexible bladder, a gas sleeve positioned around said one coupling core and around a portion of the bladder adjacent said transverse opening, said gas sleeve having a plurality of flexible fingers positioned around said one coupling core and extending in a direction toward the other coupling core, said flexible fingers being positioned to flex outwardly adjacent the inner surface of said elongate housing when said bladder is expanded.

17. A liquid module according to claim 16 characterized by said transverse opening being in said upper core, a support sleeve around a portion of said upper core and engagable with said elongate housing to support said upper core, and common means connecting said gas sleeve and said support sleeve to said upper core.

18. A liquid module according to claim 17 characterized by said gas sleeve having tangs extending longitudinally of the housing and received in shallow grooves in said support sleeve with the tangs and said support sleeve being connected by said common means to said upper core.

19. A liquid pump module for use in a well, said pump module including an elongate housing, a lower coupling core in a lower end portion of said housing, an upper coupling core in an upper end portion of said housing, passage-forming means within said housing extending between said lower coupling core and said upper coupling core and forming passages therebetween, a flexible bladder positioned around said passsage-forming means and extending between said lower and upper coupling cores, at least one of said coupling cores having means for connecting one of said passages with the outside of said flexible bladder, and a gas sleeve positioned around said one of said coupling cores, and having a plurality of flexible fingers positioned around said coupling core and adjacent the corresponding end of said bladder.

20. A liquid pump module according to claim 19 characterized by said flexible fingers being capable of flexing outwardly adjacent the inner surface of said housing when said bladder is expanded by liquid therein.

21. A liquid module according to claim 19 characterized by a support sleeve around said upper coupling core, connected thereto, and engagable with said elongate housing for supporting said upper core.

22. A liquid module according to claim 21 characterized by said upper coupling core having said means for connecting one of said passages with the outside of said flexible bladder, said support sleeve being positioned adjacent said gas sleeve.

23. A liquid module according to claim 22 characterized by common means connecting said gas sleeve and said support sleeve to said upper core.

24. A liquid module according to claim 23 characterized by said gas sleeve having tangs and said support sleeve having recesses receiving said tangs with said common connecting means being pin means extending through said support sleeve and said tangs.

25. A liquid pump module for use in a well, said pump module including a housing, a lower coupling core at a lower end of said housing, an upper coupling core at an upper end of said housing, passage-forming means within said housing extending between said lower coupling core and said upper coupling core and forming passages therebetween, a flexible, tubular bladder positioned around said passage-forming means and extending between said coupling cores, each of said coupling cores having a center core with a cylindrical portion received in an end of said tubular bladder, and a shrink band located around each of the bladder ends and clamping the bladder ends on said cylindrical portions of said center cores.

26. A pump module according to claim 25 characterized by said shrink bands having generally undulating inner surfaces engaging the bladder.

27. A liquid module according to claim 25 characterized by a gas sleeve positioned around each of said shrink bands and the corresponding clamped bladder ends.

28. A liquid module according to claim 27 characterized by each of said sleeves having a plurality of flexible fingers around said bladder and positioned to flex outwardly adjacent the inner surface of said housing when said bladder is expanded.

29. A liquid bump module assembly for use in a well, said module assembly including a pump module having a housing, a lower coupling core at a lower end of said housing, an upper coupling core at an upper end of said housing, passage-forming means within said housing extending between said lower coupling core and said upper coupling core and forming passages therebetween, a bladder positioned around said passage-forming means and extending between said coupling cores, a landing joint connected to the upper end of said housing and having passage means for supplying gas under pressure to one of said passages while exhausting gas from the other of said passages, and a bottomhole joint connected to the lower end of said pump module for supplying oil upwardly through said pump module.

30. A liquid module assembly according to claim 29 characterized by a check valve in said bottomhole joint for preventing flow of oil downwardly therethrough.

31. A liquid module assembly according to claim 30 characterized by a check valve in said landing joint for preventing flow of oil downwardly therethrough.

32. A module assembly according to claim 29 characterized by a filter sleeve with a multiplicity of openings therein connected to the bottom end of said bottomhole joint.

33. A module assembly according to claim 31 characterized by a bulbous guide connected to the bottom of said filter sleeve.

* * * * *